US005512323A

United States Patent [19]

Beane et al.

[11] Patent Number: 5,512,323

[45] Date of Patent: Apr. 30, 1996

[54] WOOD PRETREATMENT FOR WATER-BASED FINISHING SCHEDULES

[75] Inventors: Bobby E. Beane, Sophia; Eugen Safta, Winston-Salem, both of N.C.

[73] Assignee: Lilly Industries, Inc., Indianapolis, Ind.

[21] Appl. No.: 258,534

[22] Filed: Jun. 10, 1994

[51] Int. Cl.[6] ..... B05D 1/36; B05D 1/38; B05D 7/06

[52] U.S. Cl. ..... 427/408; 427/325; 427/419.1; 427/419.8

[58] Field of Search ..... 427/408, 419.1, 427/325, 337, 291, 419.8, 393

[56] References Cited

U.S. PATENT DOCUMENTS

| | | | |
|---|---|---|---|
| 3,080,257 | 3/1963 | Berry | 427/291 |
| 3,087,835 | 4/1963 | Auer | 117/73 |
| 3,438,914 | 4/1969 | Krockenberger | 260/174 |
| 3,808,037 | 4/1974 | Story | 427/419.8 |
| 3,877,979 | 4/1975 | Clark | 427/337 |
| 3,900,620 | 8/1975 | Gilman et al. | 427/408 |
| 3,928,676 | 12/1975 | Drelich | 427/341 |
| 4,732,817 | 3/1988 | Lotz et al. | 427/440 |
| 5,051,283 | 9/1991 | Beane | 427/408 |
| 5,320,872 | 6/1994 | McNeel et al. | 427/408 |

FOREIGN PATENT DOCUMENTS

| | | | |
|---|---|---|---|
| 1319110 | 6/1973 | United Kingdom | 427/408 |

OTHER PUBLICATIONS

Derwent Abstract No. 48811 of J63293006, Nov. 1988.

*Primary Examiner*—Diana Dudash
*Attorney, Agent, or Firm*—Barnes & Thornburg

[57] ABSTRACT

A wood treatment process is provided that allows surface finishing with water-based wood finishing coatings without the characteristic resultant surface roughness normally associated with the use of water-borne wood finishing compositions. The wood surface is wet with an aqueous solution of an aluminum salt and preferably dried prior to application of water-based finish coatings. The process can be carried out using novel wood stain compositions comprising aqueous solutions or suspension of aluminum salts and wood dyes.

12 Claims, No Drawings

WOOD PRETREATMENT FOR WATER-BASED FINISHING SCHEDULES

FIELD OF THE INVENTION

This invention relates to a wood treatment process. More particularly, this invention is directed to a process for reducing grain raising in wood surfaces finished with water-based wood finishing compositions.

BACKGROUND AND SUMMARY OF THE INVENTION

Over the last two decades there has been a significant evolution in coatings technology for wood finishing applications. For many years, the demands for increased production levels and consistent product quality and increasing labor costs caused industry researchers to focus on the development and use of solvent-based coating formulations. Although there has been a significant effort directed toward the development of water-based emulsion coatings as replacement for traditional solvent-based coating formulations, water-based coatings have found little acceptance and use in the wood finishing industry. That is due in part to the fact that production managers are hesitant to change existing solvent-based finishing schedules which have not only proven to provide consistent product quality, but have also been developed to do so with optimum cost efficiency. Moreover, those skilled in the wood finishing art know that water-based coatings not only suffer the inherent disadvantages of freezing in cold weather, corroding containers, and supporting bacterial growth, but they are also known to complicate, even compromise, control of finish quality. Surface hue/color is more difficult to control in water-based finishing protocols because of migration of natural and applied stains into the finish coatings. Further, water-based coatings are known to produce a characteristic rough surface due to a phenomenon referred to in the art as "grain raising". Wood fibers in the surface of the wood absorb water and swell in the presence of the water-borne coating composition. Thereafter, the wood fibers shrink as they dry resulting in wrinkles/roughness in the finished wood surface. In spite of all those problems presented by the use of water-based coatings in the wood finishing industry, proposed state and federal legislation, and promulgation of air quality rules by state and federal agencies, are requiring the wood finishing industry to find ways to use water-based coatings in wood finishing protocols as a means for reducing use and release of volatile organic compounds (VOCs).

It is one object of this invention to provide a process for treating or pretreating wood surfaces to reduce or eliminate grain raising associated with the application of water-based wood finishing compositions.

It is another object of this invention to provide a pretreatment for wood surfaces intended to be stained and coated with one or more non-pigmented water-based coating formulations.

In a further embodiment, this invention provides a novel wood stain composition for use in wood finishing protocols utilizing water-based sealers and/or topcoats.

In still another aspect of this invention there is provided a method for reducing grain raising in wood surfaces prone to exhibit such condition when finished with water-based finish coating compositions.

Another embodiment of this invention provides a veneer treatment process and processed veneer which can be finished utilizing water-based finish coating compositions without associated grain raising and resultant surface roughness.

Those and other embodiments of this invention are accomplished by a wood pretreatment process including the step of wetting the surface of a wood substrate with a solution of an effective amount of aluminum salt. Preferably the aluminum salt solutions are acidic (pH< 7) and contain about 1 to about 15 weight percent of an aluminum salt. In wood finishing protocols requiring application of a stain, it is preferred that the stain be applied to the surface prior to the treatment in accordance with this invention, or at the same time utilizing the novel water-based, aluminum salt-containing, stain compositions of this invention. The invention finds application in industrial manufacturing operations, such as furniture manufacture, requiring production of high quality wood finishes. The process of the present invention can be implemented within the framework of most existing wood finishing protocols with little, if any, additional equipment and/or labor cost.

The invention also finds application in pretreatment of veneer destined for use in the manufacture of furniture, cabinetry and other high quality wood finish applications. Veneer can be treated in accordance with this invention and delivered in a pretreated state to manufacturers using water-based finishing protocols.

DETAILED DESCRIPTION OF THE INVENTION

Perhaps the most significant problem deriving from the use of water-borne coatings in wood finishing applications is that denominated by those skilled in the art as "grain raising". Wood fibers in the finished surface absorb water and swell upon application of water-based finish compositions. The problem is exacerbated by the fact that the fibers in one area of a wood surface can absorb more water than others, leading to varying degrees of surface roughness on any given finished surface. When water-based coatings are applied to a wood surface, the wetted wood fibers absorb water and swell and then shrink again after the coating itself dries, thus leading to wrinkling of the applied coating. The present invention is based on the discovery that wood surfaces, pretreated by wetting with an aqueous solution of aluminum salts will have much reduced tendency to absorb water from subsequently applied water-based coatings. Thus wood surfaces treated in accordance with this invention can be stained and finished with, for example, non-pigmented, water-based acrylic sealants and topcoats to provide high quality wood finishes equal in quality to those obtained using existing solvent based finishing schedules.

Stain-based finishing schedules vary widely dependent on the type and quality of wood, and the nature and targeted quality of the desired finish. Typically, however, they have in common the processing steps of coarse sanding, finish sanding, staining (by any of a variety of techniques) and application of various finish coating formulations including wash coats, sanding sealers, wash coat toners, glazing sealers, shade stains, and topcoat formulations among others. The wood treatment process in accordance with this invention is typically implemented by adding the step of wetting the wood surface with an aluminum salt solution at a point in the finishing schedule after coarse sanding and before application of any film-forming finish compositions. Preferably the present wood treatment process is implemented in a wood finishing schedule after coarse sanding and before finish sanding, more preferably after staining or during the staining process using water-based aluminum salt solutions containing compatible wood staining dyes. The application of aluminum salt solutions to wood surfaces prior to the step of staining has been found to be less desirable because aluminum-solution-treated wood has been found to be more difficult to stain.

Thus in accordance with this invention there is provided a method of reducing grain raising and consequent roughness of wood surfaces prone to exhibit such condition when finished with a water-based finish coating composition. Examples of wood types known to be particularly susceptible to problems associated with grain raising on application of water-based coating compositions include oak, pine, cherry, walnut, ash, rubber wood, and maple.

The method comprises the step of wetting the wood surface with an aqueous solution of an aluminum salt, and preferably drying the surface prior to applying the water-based finish composition. The invention finds particular application in manufacturing operations using stain-based finishing schedules adapted to produce high quality wood finishes.

It is also contemplated in accordance with this invention that the wood treatment process can be applied in the manufacture of veneer. Veneer can be pretreated in accordance with this invention by wetting the veneer surface of the veneer with an aqueous solution of an aluminum salt and drying the surface to provide a treated veneer which can be subjected to water-based finishing protocols without compromise of finish quality due to the grain raising.

The present invention can also be used on pressboard or fiberboard typically fabricated by heating and compacting a mat formed by dewatering an aqueous suspension of comminuted wood and a thermosetting binder in accordance with procedures well known in the art. Aqueous aluminum salt solutions can be applied to the surface of the fabricated boards prior to application of water-based coatings to reduce grain raising and thereby enhance the finished surface quality of applied water-based coating compositions.

The aluminum salts finding use in accordance with this invention may be selected from any of a wide variety of water soluble aluminum salts of mono-, di- or tri-basic acids, mixed acid salts of aluminum and one or more monovalent cations selected from sodium, potassium and ammonium, and hydrated forms of such salts. The nature of the aluminum salt is not critical so long as it is sufficiently water soluble to provide a water solution at an effective aluminum salt concentration. Exemplary of suitable aluminum salts include aluminum sulfate, aluminum phosphate, aluminum ammonium sulfate, aluminum chloride, aluminum nitrate, aluminum potassium sulfate, aluminum sodium sulfate, aluminum acetate and the like. Preferred aluminum salts, because of their functionality and cost efficiency, are aluminum salts of inorganic acids, most preferably aluminum sulfate and aluminum ammonium sulfate and hydrated forms thereof (alum).

The aluminum salt solutions used to wet wood surfaces in accordance with this invention typically contain between about 1 and about 15 percent by weight, more preferably about 5 to about 12 percent by weight of the aluminum salt. Higher concentrations of aluminum salts can be used assuming their water solubility allows it, but such is typically without functional advantage and certainly without economic advantage. Typically the aluminum salt used to wet the wood surface in accordance with the present invention is about 10 to about 100 percent saturated with the aluminum salt. Preferably the solutions have a pH<7, more preferably between 2.5 and about 6.5, and most preferably between about 3.5 and about 5.5. While many aluminum salts impart a natural acidity to such solutions, the pH can be readily adjusted by the addition of mineral or organic acids. The aqueous aluminum salt solutions prepared for application in accordance with the invention can be formulated to contain other ingredients intended to enhance functionality. Thus a wetting agent, for example, a nonionic or cationic surfactant, can be added in an amount effective to reduce surface tension of the aluminum salt solution and improve its capacity to wet and/or penetrate the wood surface.

In one embodiment of the present invention there is provided a novel wood staining composition comprising an aqueous solution or dispersion of aluminum salt and a wood stain. The composition can be applied as a stain to a wood surface and at the same time be used to treat the surface in accordance with this invention to provide resistance to grain raising with subsequent application of water-based coating compositions. The aluminum salt component of the aluminum salt-containing wood stain composition in accordance with the present invention can be any of those aluminum salts referenced above as useful in forming the aluminum salt solutions. The stain composition comprises about 1 to about 15 weight percent, more preferably about 5 to about 12 weight percent of an aluminum salt and a wood stain compatible with the aluminum salt solution. Compatibility of a stain or dye with the aluminum salt solution requires that the stain or dye retain its characteristic color and adequate solubility in the aluminum salt-containing solution. One can test dye/stain compatibility with such solutions by simply forming test solutions of aluminum salt with such dyes/stains and observing color change and/or precipitation effects. Suitable dyes are typically cationic dyes, most preferably azo acid dyes. Exemplary of such are Fast Wool Yellow 3GL, Acid Black 2B and Acid Scarlet Moo, available from Crompton & Knowles Corporation, Dyes and Chemical Division, Reading, Pa. Other dyes and dye combinations having the requisite compatibility with the aluminum salt solution can be used to formulate the novel aluminum salt/dye compositions in accordance with this invention. The dye components are utilized alone or in combination at concentrations sufficient to provide the desired color uptake by the wood surface during wetting the wood surface with the dye formulation in accordance with the present invention. The exact quantities of dye can be determined by skilled practitioners on a case-by-case basis to achieve the wood coloration desired for each unique application. The pH of the stain composition in accordance with this invention is preferably less than 7, more preferably about 2.5 to about 6.5, and most preferably about 3.5 to about 5.5. The pH can be adjusted by the addition of mineral or organic acids.

The aluminum salt solutions utilized in accordance with this invention can be applied to wood surfaces by brushing, dipping, spraying, pouring, curtain coating, or any other art recognized means of application. Wood surfaces prepared for subsequent applications of water-based finish coating compositions are typically prepared by dipping or spraying the aqueous aluminum salt solution onto the wood surface. They can be applied at ambient temperature or at elevated temperatures up to the boiling point of the solution. The solution is preferably applied after coarse sanding and initial staining and before fine sanding and application of film-forming finish coating formulations. However, it is contemplated that the aqueous aluminum solution can be applied to effectively reduce grain raising as a lightly resinous (<20% solids) wash coat after stain application and before finish sanding, filling, sealing and application of water-based topcoats.

After application of the aluminum salt solution in accordance with the present invention, the wood surface is preferably dried prior to application of water-based finish coating compositions. Any art-recognized techniques for surface drying may be utilized. Thus the wood surface may be allowed to air dry at ambient temperature for at least 1 hour, or force dried in an oven (at least 10 minutes) or under an infra-red lamp (at least 2 minutes). It is preferred that the drying step include the step of applying heat or heated air to the wetted surface of the wood substrate.

The water-based coating compositions referred to in this description of the present invention typically comprise a dispersed vinyl addition-type polymer, including homopolymers and copolymers of (1) vinyl esters of an aliphatic acid having 1 to 18 carbon atoms, especially vinyl acetate; (2) acrylic acid esters and methacrylic acid esters of an alcohol having 1 to 18 carbon atoms, especially methylacrylate, ethylacrylate, butylacrylate, 2-ethylhexylacrylate, methyl methacrylate, and butyl methacrylate; and mono- and diethylenically unsaturated hydrocarbons, such as ethylene, isobutylene, styrene and aliphatic dienes such as butadiene, isoprene and chloroprene.

Poly(vinylacetate) and copolymers of vinylacetate with one or more of the following monomers; vinyl chloride, vinylidene chloride, styrene, vinyl toluene, acrylonitrile, methacrylonitrile, and one or two of the acrylic and methacrylic acid esters mentioned above, are well known as film-forming components of water-based paints. Similarly copolymers of one or more of the acrylic or methacrylic esters mentioned above with one or more of the following monomers: vinylacetate, vinyl chloride, vinylidene chloride, styrene, vinyl toluene, acrylonitrile, and methacrylonitrile are conventionally employed in aqueous-based paints. It is common to include a small amount, such as about 0.5 to about 2.5 percent or more, of an acid monomer in the monomer mixture used for making the copolymers of all three general types mentioned above by emulsion polymerization. Acids used include acrylic, methacrylic, ithaconic, aconitic, citraconic, crotonic, maleic, fumaric, the dimer of methacrylic acid, etc. The aqueous dispersions are made using one or more emulsifiers of anionic, cationic or nonionic character, or mixtures of two or more such emulsifiers may be used except that it is generally undesirable to mix a cationic with an anionic emulsifier in any appreciable amount since they tend to neutralize each other. Those and other guidelines for preparation of aqueous emulsion-type coatings are well known to those of ordinary skill in the art and can be applied to the water-thinned coatings finding use for obtaining high quality finishes in wood finishing operations in accordance with the present invention.

The following non-limiting examples are provided to further illustrate the method and composition of the present invention.

EXAMPLE 1

Comparative Finish Treatment of Oak Solids and Veneer Panel

An oak solids and veneer panel was split and finished in two parts as listed under Side A and Side B as follows:

| SIDE A | SIDE B |
|---|---|
| 1. Spray with 10% by weight solution of aluminum ammonium sulfate and water. | 1. No treatment |
| 2. Air flash dry - 5 minutes. | 2. Same as Side A |
| 3. Force dry 7 minutes at 120° F. | 3. Same as Side A |
| 4. Sand. | 4. Same as Side A |
| 5. Apply conventional wood stain. | 5. Same as Side A |
| 6. Dry completely. | 6. Same as Side A |
| 7. Apply by spray water-borne wash coat - 20% solids acrylic latex. | 7. Same as Side A |
| 8. Dry completely. | 8. Same as Side A |
| 9. Apply water-borne sealer - 29% solids acrylic latex. | 9. Same as Side A |
| 10. Force dry 8 minutes at 120° F. | 10. Same as Side A |
| 11. Apply water-borne topcoat - 28% solids acrylic latex. | 11. Same as Side A |

Results

No grain raising was noted on Side A while Side B exhibited severe surface roughness due to grain raising.

EXAMPLE 2

Comparative Finish Treatment of Oak Solids And Veneer Panel Using Wood Stain/Aluminum Salt Solution An oak solids and veneer panel was split and finished in two parts in accordance with the procedures listed for Side A and B as follows:

| SIDE A | SIDE B |
|---|---|
| 1. Panel was sprayed with a 10% by weight solution of aluminum ammonium sulfate in combination with an acid dye. | 1. A conventional wood stain was spray-applied to the wood surface |
| 2. Air flash dry - 5 minutes. | 2. Same as Side A |
| 3. Force dry 7 minutes at 120° F. | 3. Same as Side A |
| 4. Sand. | 4. Same as Side A |
| 5. Spray apply water-borne wash coat - 20% solids acrylic latex. | 5. Same as Side A |
| 6. Force dry 8 minutes at 120° F. | 6. Same as Side A |
| 7. Spray apply an aqueous wiping stain and then wipe surface with a rag. | 7. Same as Side A |
| 8. Force dry 8 minutes at 120° F. | 8. Same as Side A |
| 9. Spray apply water-borne sealer - 29% solids acrylic latex. | 9. Same as Side A |
| 10. Force dry 8 minutes at 120° F. | 10. Same as Side A |
| 11. Spray apply water-borne topcoat - 29% solids acrylic latex. | 11. Same as Side A |
| 12. Force dry 10 minutes at 120° F. | 12. Same as Side A |

Results

Side A exhibited no roughness due to grain raising while Side B exhibited severe roughness associated with grain raising.

EXAMPLE 3

White Pine—Water-Based White Enamel Finish Coat

A white pine panel was split and finished in two parts as listed under as Side A and B as follows:

| SIDE A | SIDE B |
|---|---|
| 1. Spray-apply a 10% by weight solution of aluminum ammonium sulfate and water. | 1. No treatment |
| 2. Air flash dry - 5 minutes. | 2. Same as Side A |
| 3. Force dry 7 minutes at 120° F. | 3. Same as Side A |
| 4. Sand. | 4. Same as Side A |
| 5. Apply white water-borne enamel. | 5. Same as Side A |
| 6. Force dry 8 minutes at 120° F. | 6. Same as Side A |

Results

Side A evidenced no grain raising with a smooth finish and no rosin bleeding. Side B exhibited severe grain raising and severe rosin bleeding.

EXAMPLE 4

Aluminum Salt Stain Composition

Aqueous solutions of aluminum sulfate at 2, 5, 7 and 10 weight percent aluminum sulfate are prepared and portions of each are used for assessment of compatibility with art-recognized dye compositions for wood stains. Dyes compatible with each of the aluminum salt solutions include Fast Wool Yellow 3GL, Acid Black 2B and Acid Scarlet Moo from Crompton & Knowles Corporation. They are added to the aluminum salt solutions at about 0.2 to about 10 weight percent dye. Each dye retains its color and remains in solution during a two-day observation period. Compatible dyes are identified and added compositions alone or in combination with other compatible dyes to the respective aluminum sulfate solutions to form stains in accordance with this invention which can be used to stain wood surfaces and render them resistant to grain raising upon application of water-based finish coating compositions.

We claim:

1. In a wood finishing process comprising application of a stain to the surface of a wood substrate and subsequent application of at least one water-based film-forming coating composition comprising a vinyl addition polymer, the improvement comprising wetting said surface with a solution of an aluminum salt prior to applying the water-based film-forming coating composition wherein the solution of aluminum salt is of a concentration and pH sufficient to reduce grain raising, relative to that of wood finished without said solution, upon subsequent contact of the wood with the water-based film forming coating composition.

2. The process improvement of claim 1 further comprising the step of drying the surface of the wood substrate after wetting with the aluminum salt solution and prior to applying the water-based coating composition.

3. The process improvement of claim 2 wherein the aluminum salt solution is an aqueous solution having a pH of about 2.5 to about 6.5.

4. The process improvement of claim 1 wherein the aluminum salt solution is applied after application of the stain to the surface.

5. The process improvement of claim 1 wherein the aluminum salt solution includes the stain so that the stain is applied to the wood surface during the step of wetting the surface with the aluminum salt solution.

6. The process improvement of claim 1 wherein the salt solution comprises about 1 to about 15 weight percent of an aluminum salt selected from aluminum salts of mono-, di- or tri-basic acids, mixed acid salts of aluminum and one or more monovalent cations selected from sodium, potassium and ammonium, and hydrated forms of said aluminum salts.

7. The process improvement of claim 6 wherein the salt solution further comprises a wood stain.

8. The process improvement of claim 6 further comprising the step of drying the surface of the wood substrate prior to application of the water-based coating.

9. The process improvement of claim 8 wherein the drying step includes heating the surface of the wood substrate.

10. A method for reducing surface roughness due to grain raising on a wood substrate finished using a stain based wood finishing protocol including the steps of staining a surface of the wood substrate and thereafter applying to the stained surface a water-based film-forming coating composition comprising a vinyl addition polymer, said method comprising applying an aqueous solution of an aluminum salt to wet the wood surface and drying the wetted wood surface prior to application of the film-forming coating composition.

11. The method of claim 10 wherein the pH of the aqueous solution is about 2.5 to about 6.5.

12. The method of claim 10 wherein the drying step includes the step of heating the wood surface.

* * * * *